US005594970A

United States Patent [19]

Benge

[11] Patent Number: 5,594,970

[45] Date of Patent: Jan. 21, 1997

[54] PERSONAL CLEANSING IMPLEMENT USING KNITTED TUBING

[75] Inventor: W. Dennis Benge, Covington, Ky.

[73] Assignee: The Procter & Gamble Company, Cincinnati, Ohio

[21] Appl. No.: 381,263

[22] Filed: Jan. 31, 1995

[51] Int. Cl.[6] ..... A47L 17/08; D04B 21/16

[52] U.S. Cl. ..... 15/208; 15/210.1; 428/246; 428/253; 428/224; 66/170

[58] Field of Search ..... 15/208, 209.1, 15/210.1, 229.11, 229.12, 229.13, 223, 225, 222, 226, 230.15; 428/194, 192, 193, 246, 253, 913, 22.1, 197, 198, 57, 58, 196, 220, 225; 29/419.1, 469; 300/21; 66/170, 169 R

[56] References Cited

U.S. PATENT DOCUMENTS

| | | | |
|---|---|---|---|
| 1,533,868 | 4/1925 | Kingman | 15/229.1 |
| 1,658,048 | 2/1928 | Herzfeld | 66/170 |
| 1,659,977 | 2/1928 | Kingman | 15/208 |
| 1,689,207 | 10/1928 | Kingman | 15/229.1 |
| 1,794,854 | 3/1931 | Kean | 15/229.1 |
| 1,865,785 | 7/1932 | Parker | 15/209.1 |
| 1,963,529 | 6/1934 | Protz | 15/208 |
| 2,151,448 | 3/1939 | Steinberg | 15/208 |
| 2,421,357 | 5/1947 | Saftlas | 66/170 |
| 2,425,293 | 8/1947 | McDermott | 66/9 A |
| 2,601,771 | 7/1952 | Cameron | 15/229.1 |
| 2,857,610 | 10/1958 | Rympalski | 15/229.1 |
| 2,940,100 | 6/1960 | Grossmeyer | 15/118 |
| 3,169,264 | 2/1965 | Walker | 15/118 |
| 3,241,171 | 3/1966 | Benjamin et al. | 15/118 |
| 3,711,889 | 1/1973 | Jennings | 15/227 |
| 3,772,728 | 11/1973 | Johnson | 15/209 R |
| 3,778,172 | 12/1973 | Myren | 401/7 |
| 3,977,452 | 8/1976 | Wright | 15/209.1 |
| 4,017,949 | 4/1977 | Botvin | 28/77 |
| 4,040,139 | 8/1977 | Botvin | 15/209 B |
| 4,052,238 | 10/1977 | Botvin | 156/148 |
| 4,144,612 | 3/1979 | Yamaguchi | 15/208 |
| 4,154,542 | 5/1979 | Rasmason | 401/7 |
| 4,168,863 | 9/1979 | Hatcher | 15/229.1 |
| 4,196,490 | 4/1980 | Jonzon | 15/222 |
| 4,206,948 | 6/1980 | Shimizu | 300/21 |
| 4,287,633 | 9/1981 | Gropper | 15/209 B |
| 4,343,061 | 8/1982 | Hanazono | 15/244 B |
| 4,457,640 | 7/1984 | Anderson | 401/7 |
| 4,462,135 | 7/1984 | Sanford | 15/105 |
| 4,473,611 | 9/1984 | Haq | 15/118 |
| 4,651,505 | 3/1987 | Gropper | 53/456 |
| 4,769,022 | 9/1988 | Chang et al. | 604/368 |

(List continued on next page.)

FOREIGN PATENT DOCUMENTS

| | | |
|---|---|---|
| 0086355 | 1/1983 | European Pat. Off. . |
| D/023748 | 11/1992 | European Pat. Off. . |
| 2934293A1 | 8/1979 | Germany . |
| 1473147 | 9/1974 | United Kingdom . |
| 2237196 | 5/1991 | United Kingdom . |

*Primary Examiner*—Gary K. Graham
*Attorney, Agent, or Firm*—Ronald W. Kock

[57] ABSTRACT

A personal cleansing implement comprises a substantially rectangular hydrophobic batt. The batt is a piece of knitted tubing made from extruded linear low density polyethylene monofilaments knitted into a tube on a knitting machine having a setting ranging from 32 to 64 needles per machine diameter. The monofilaments have substantially circular cross-sections in the range of 0.003 inches to 0.015 inches diameter. The piece of knitted tubing also has a longitudinal axis with about 6 to about 9 stitches per inch, as typically measured along its longitudinal axis. Furthermore, the piece of knitted tubing is inverted upon itself at least once along its longitudinal axis to form a plurality of concentric layers of tubing, which are then substantially flattened to form the batt. Each of the layers has a similar length and substantially overlaps the other layers. The batt has a top surface, a bottom surface, and two open ends. The top and bottom surfaces are bonded together at the two open ends by a bonding means to maintain the implement substantially flattened. However, the batt retains sufficient loft to function as a personal cleansing implement.

9 Claims, 1 Drawing Sheet

U.S. PATENT DOCUMENTS

| | | | |
|---|---|---|---|
| 4,893,371 | 1/1990 | Hartmann | 15/209 B |
| 4,948,585 | 8/1990 | Schlein | 424/40 |
| 4,969,226 | 11/1990 | Seville | 15/244.4 |
| 4,986,681 | 1/1991 | Oliver | 401/7 |
| 4,993,099 | 2/1991 | Emura et al. | 15/118 |
| 5,144,744 | 9/1992 | Campagnoli | 29/446 |
| 5,187,830 | 2/1993 | Giallourakis | 15/244.3 |
| 5,229,181 | 7/1993 | Daiber et al. | 428/58 |
| 5,295,280 | 3/1994 | Hudson | 15/222 |

PERSONAL CLEANSING IMPLEMENT USING KNITTED TUBING

FIELD OF THE INVENTION

The present invention relates to hand held implements used for personal cleansing, and more particularly to such implements having scrubbing surfaces made from hydrophobic knitted monofilaments.

BACKGROUND OF THE INVENTION

A variety of cleansing implements have been used to remove dirt and dead skin from the user's body during bathing or showering. Traditionally, hand held terry washcloths and natural and synthetic sponges have been used. Each of these has one or more significant deficiencies. For example, a sponge has pores which make it difficult to remove dirt from the implement once the dirt is removed from the body. A washcloth often impedes lathering even though lathering is a primary function of a cleansing implement. Some sponges absorb the cleansers that are intended to help remove dirt. Neither sponges nor washcloths can be dried quickly because they become water-logged. As a result they develop unpleasant odors and become a place for breeding bacteria, mold, etc. Also, such implements are typically not suitable for cleaning all body parts. Washcloths are too soft to stimulate and exfoliate skin, and sponges are too rough to cleanse sensitive skin areas.

Ball-like structures made of polymer netting have also been found in the prior art. An example is disclosed in U.S. Pat. No. 5,144,744 to Campagnoli, issued Sep. 8, 1992. Ball-like structures are hand held and are made of diamond-mesh polyethylene. Diamond-mesh polyethylene is an extruded scrim material which is commonly found covering vegetables, meat, and poultry. Commercially available implements of this type are sold by The Body Shop of London, England; and by Bilange of New York, N.Y. Such constructions are very expensive because they have typically been made by hand.

One way to make such ball-like structures is to stretch multiple tubular pieces of diamond-mesh scrim transversely to their tubular axes. Each piece is then placed over separate support posts. The supported pieces, held in a stretched condition, are arranged either parallel to or at different angles to each other. By tying together the stretched pieces at their centers, and then releasing the resilient pieces from the support posts, each piece springs back toward the tied center to generate a ball-like shape.

Cinching the scrim at the centers of the pieces produces a hard dense core, which hinders rinsing and drying. While the surface of a ball-like structure may have high open area at tits surface, it is difficult to clean the center of the implement for reuse.

Knitted tubing made from plastic filaments is another material found in the scrubbing implement art. Knitted tubing is often avoided for such implements, however, because it is viewed as a more expensive material than an extruded scrim. While the material itself may be more expensive, implements made of knitted tubing may have a better "feel" to one's skin. Knitted filaments can be sized and shaped to feel softer than extruded scrim when a personal cleansing implement is rubbed against one's skin. The individual stitches are free to move and deform when touching the skin, whereas extruded scrim implements have apertures formed by strands which are fixed together at their crossing points. Such strands must move and deform as a group rather than individually, and therefore provide a stiffer structure for similar density and open area. Furthermore, knitted filaments are interlocked in a way that provides a structure having a natural loft, whereas scrim is typically flat and requires heat setting pleats to create a lofted structure.

Although knitted scrubbing implements are known in the art, they are generally knitted of metal or rough fibers for the purpose of being abrasive for removing soil from hard surfaces. For example, U.S. Pat. No. 4,017,949 to Botvin discloses a scouring pad and method of making it. A knit polypropylene filament tubular envelope surrounds a stuffer material. In a later Botvin patent the stuffer material is the same as the knit envelope. The method turns the envelope "inside out", or inverts it. The flattened tubing is heat sealed across the open ends. Filaments are either ribbon-like or are elliptical filaments having a cross-section with major axis of 0.030 inches and minor axis of 0.009 inches. The advantage of ribbon and other slit films for abrasive scrubbing is that they fibrilate, creating a rough surface. Implements made of such materials are not sufficiently gentle when rubbed against human skin to be considered "soft", and therefore are not acceptable personal cleansing implements.

SUMMARY OF THE INVENTION

In one aspect of the present invention, a personal cleansing implement comprises a substantially rectangular hydrophobic batt, which is a piece of knitted tubing made from extruded plastic monofilaments knitted on a knitting machine having a setting of from 32 to 64 needles per machine diameter. The monofilaments have substantially circular cross-sections in the range of 0.003 inches to 0.015 inches diameter. The piece of knitted tubing has a longitudinal axis. The piece of knitted tubing has about 6 to about 9 stitches per inch along the longitudinal axis, as typically measured by hand in the industry. The piece of knitted tubing is inverted upon itself at least once along the longitudinal axis to form a plurality of concentric layers of tubing. Each of the layers has about the same length and substantially overlaps the other layers. The batt has a top surface, a bottom surface, and two open ends when the piece of knitted tubing is inverted upon itself and then substantially flattened perpendicular to the longitudinal axis. The top surface and the bottom surface are bonded together at the two open ends by a bonding means to maintain the batt substantially flattened. The personal cleansing implement may further comprise a means for hanging so that it may more quickly dried after rinsing.

The preferred extruded plastic monofilament is linear low density polyethylene. Such a monofilament, in the above diameter range and spacing parameters provides an adequately soft "feel" when a personal cleansing implement is constructed in this manner. More preferably, the monofilaments have a diameter of less than 0.009 inches and the batt comprises 8 layers of knitted tubing when substantially flattened.

In another aspect of the present invention, a method of constructing a personal cleansing implement comprises the steps of knitting a piece of tubing on a knitting machine having a setting ranging from 32 to 64 needles per machine diameter, and using extruded plastic monofilaments having substantially circular cross-sections in the range of 0.003 inches to 0.015 inches diameter. The piece of tubing has about 6 to about 9 stitches per inch as typically measured along a longitudinal axis of the tubing. Another step involves inverting the piece of tubing on itself at least once along the longitudinal axis to form a plurality of concentric layers of tubing. Each of the layers is inverted to have a similar length and such that the layers substantially overlap the other layers. Yet another step involves substantially flattening the piece of tubing perpendicular to the longitudinal axis to form a bait. Flattening generates a top surface and a bottom surface of the batt. The batt has two open ends. A final step involves bonding together the top and bottom surfaces of the batt at the two open ends by a bonding means to maintain the batt substantially flattened.

The method may further comprise the step of attaching a tether to the piece of tubing for hanging the personal cleansing implement. The bonding means may include stitching or thermobonding.

BRIEF DESCRIPTION OF THE DRAWINGS

While the specification concludes with claims which particularly point out and distinctly claim the present invention, it is believed that the present invention will be better understood from the following description of preferred embodiments, taken in conjunction with the accompanying drawings, in which like reference numerals identify identical elements and wherein:

DETAILED DESCRIPTION OF THE INVENTION

Figure 1:
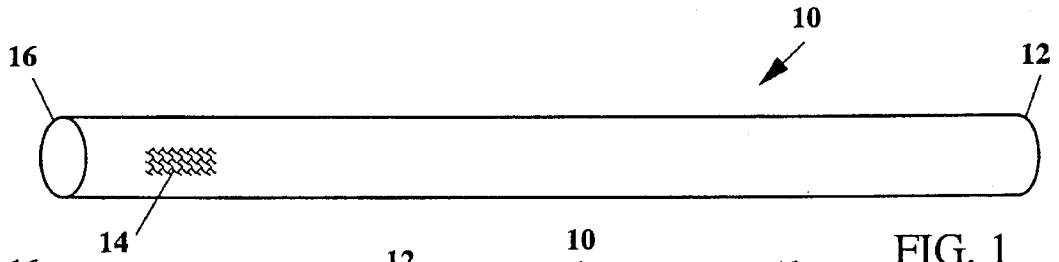
FIG. 1 is a perspective view of a preferred piece of knitted tubing of the personal cleansing implement of the present invention, disclosing a tube having considerably greater length than diameter.

Referring now to the drawings, and more particularly to FIG. 1, there is shown a first preferred embodiment of the present invention, which provides a piece of knit tubing, and is generally indicated as 10. Tubing 10 is knitted on a commercial knitting machine, such as a standard 12 inch diameter circular knitting machine, made by Scott & Williams of New York, N.Y. A high open area is achieved between monofilaments by a 32 to 64 needle cross-stitch. This generates a spacing of monofilaments of about 6 to about 9 monofilaments per inch of tubing, as typically measured in the industry along the longitudinal axis of the tubing by hand stretching and measuring a short piece of tubing. The preferred lathering benefit associated with such a knit implement is believed due to this spacing between monofilaments. Piece of knit tubing 10 is preferably made of extruded plastic monofilaments. Extruding the filaments avoids fibrillation and roughness associated with slit film filaments. Fibrillation and roughness provide poor rinsing and drying capability. Fibrillated strands hold water by capillary action.

The preferred soft "feel" of a knit implement is believed primarily due to the size and shape of the extruded monofilament used. Preferred monofilaments are substantially circular in cross-section, having a diameter ranging from 0.003 inches to 0.015 inches. Within this diameter range different materials have different stiffnesses. It is believed that monofilament stiffness is the primary variable controlling soft "feel". Within a given implement it is possible to use two different size or two different material monofilaments to create a composite which has the most acceptable "feel". However, for the lowest cost implement it has been found that extruded monofilaments made of linear low density polyethylene, and sized less than 0.009 inches in diameter, have an optimum "feel".

Circular cross-section filaments easily twist when rubbed against one's skin. Ease of twisting also helps circular cross-section monofilaments pass from bobbins through the guides of the knitting machine without breaking. For the particular knitting machine and filament material and size noted above, it is believed that ovality of monofilament cross-sections of 1.7:1 or greater major/minor diameter ratio tended to break as they passed through the machine.

Tubing 10 is approximately 5 inches in diameter. Lengths between 24 and 28 inches long are cut from the continuously knit tubing to generate personal cleansing implements of the present invention.

Figure 2:
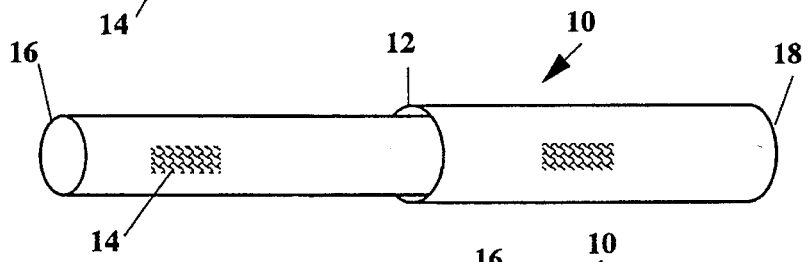
FIG. 2 is a perspective view thereof, showing the right end folded back over at least one quarter the original length of the tubing.
Figure 3:
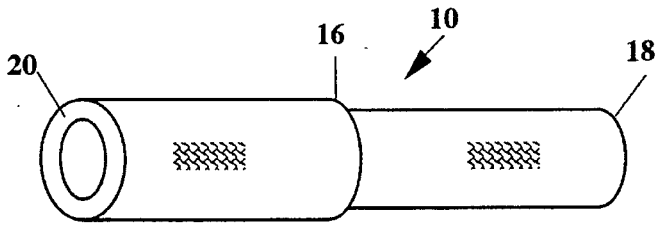
FIG. 3 is a perspective view thereof, showing the left end folded back over at least one quarter the original length of the tubing.

FIG. 2 shows a right end 12 of tubing 10 being inverted or folded back over an outside surface 14 of tubing 10 toward a left end 16. Preferably, both right and left ends of tubing 10 are inverted over outside surface 14 such that ends 12 and 16 overlap slightly near the center of tubing 10. New opposite ends 18 and 20 are formed by such inverting. End 20 is then inverted again, but this time end 20 reaches end 18 to create four concentric layers of tubing which substantially overlap each other and have open ends 22 and 24.

Figure 4:
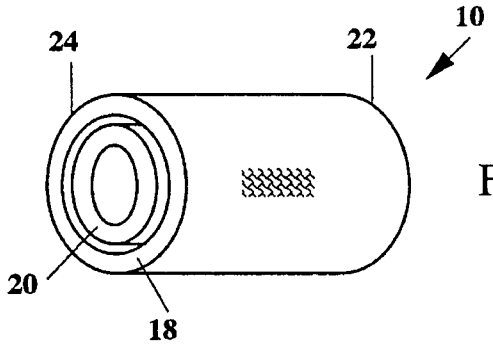
FIG. 4 is a perspective view thereof, showing the inverted right end folded back over the inverted left end of the tubing such that the resulting concentric layers which are exposed have substantially the same length and their ends are flush.
Figure 5:
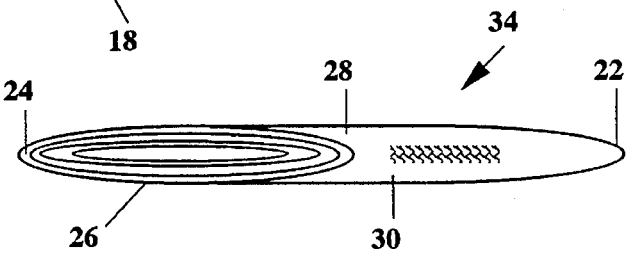
FIG. 5 is a perspective view thereof, showing the inverted tubing flattened to form a rectangular batt.
Figure 6:
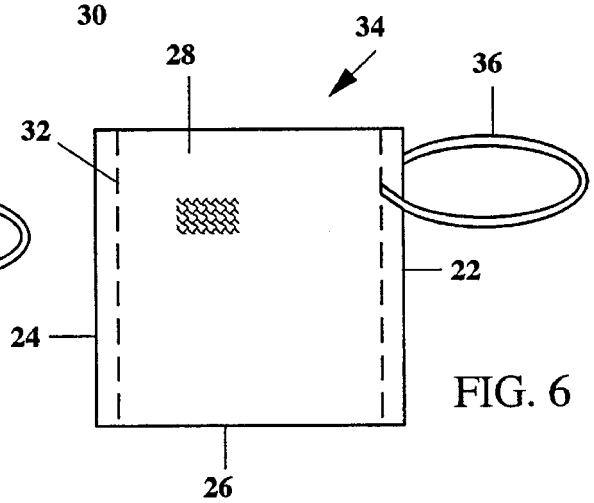
FIG. 6 is a top plan view of a flattened batt, showing stitches across the two open ends of the tubing, and a tether looped through the batt.

FIGS. 4 and 5 show the twice inverted knit structure having open ends 22 and 24. FIG. 5 also shows the flattening of tubing 10 into an 8 layer bait 26 having a top surface 28 and a bottom surface 30. Batt 26 is maintained substantially flattened by closing ends 22 and 24. Closing is accomplished by stitching or by thermobonding processes, commonly known in the art. Thermobonding may include heated die contact, adhesive, ultrasonic welding, or other thermal processes. Stitching permits a connection which is less stiff and dense than that which thermobonding normally provides. Stitching is shown in FIG. 6. A closed batt 26 forms a personal cleansing implement, generally indicated as 34.

Figure 7:
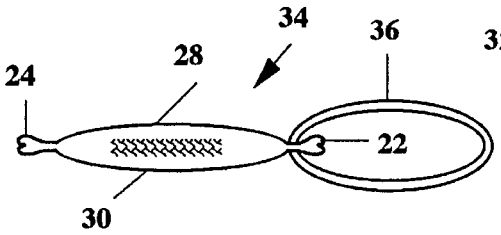
FIG. 7 is a front elevation view thereof, showing the batt maintained substantially flattened due to end closing, but with sufficient loft to be used as a personal cleansing implement.

During or after closing the ends of inverted tubing 10, a tether 36 is preferably attached to batt 26 by threading it through top and bottom surfaces 28 and 30. This is shown in FIGS. 6 and 7. The tether is preferably placed inside a stitch and near a corner of the implement. Tether 36 enables the user to hang the personal cleansing implement after rinsing in order that it may dry quickly. Tether 36 is preferably hydrophobic braided rope made of polypropylene made of a 3.5 mm diameter hydrophobic rope material, such as specification number W-01 available from Maxi-Cord of Chicago, Ill.

Implement 34 has a high open area, resilience, and its materials are hydrophobic. This combination provides a significant amount of lather when used with a liquid, gel, or solid form of skin cleanser. The implement is held in one hand. Cleanser is preferably added to the implement rather than to the skin. The cleanser is then rubbed against the skin by the implement in the presence of water, lifting dirt and exfoliated skin into the implement. It is believed that lathering enhances the removal of dirt and exfoliated skin from the surface of the body. The implement of the present design enables substantially more lather and better consistency lather to be developed than is generally possible with a washcloth or sponge.

Once bathing or showering are completed, implement 34 may be quickly rinsed and dried, thereby avoiding the slow drying of washcloths, sponges, or implements with hard dense cores. The construction of implement 34 provides a center portion which has no hard, dense core. The structure of implement 34 is therefore believed to be more sanitary than most prior art personal cleansing implements.

If stitches are used instead of thermobonding, stitches are preferably made of hydrophobic thread made of polyester. Such thread is commercially available from Beachwood, Ltd. of Cleveland, Ohio. It has a specification number 2743 MAA.

While particular embodiments of the present invention have been illustrated and described, it will be obvious to those skilled in the art that various changes may be made without departing from the spirit and scope of the invention, and it is intended to cover in the appended claims all such modifications that are within the scope of the invention.

What is claimed is:

1. A personal cleansing implement comprising a substantially rectangular hydrophobic batt, said batt being a piece of knitted tubing made from extruded plastic monofilaments, said monofilaments having circular cross-sections in the range of 0.003 inches to 0.015 inches diameter, said piece of knitted tubing having a longitudinal axis, said piece of knitted tubing being inverted upon itself along said longitudinal axis to form a plurality of concentric layers of tubing, each of said layers having a similar length and substantially overlapping all other layers, said batt having a top surface, a bottom surface and two ends perpendicular to said longitudinal axis, said batt being substantially flattened perpendicular to said longitudinal axis, and said top surface and said bottom surface being bonded together at said two ends by a bonding means to maintain said bait substantially flattened.

2. The personal cleansing implement of claim 1 further comprising a means for hanging said personal cleansing implement.

3. The personal cleansing implement of claim 1 wherein said bonding means comprises stitching.

4. The personal cleansing implement of claim 1 wherein said bonding means comprises thermobonding.

5. The personal cleansing implement of claim 1 wherein said extruded plastic monofilament comprises linear low density polyethylene.

6. The personal cleansing implement of claim 1 wherein said monofilaments have a diameter less than 0.009 inches.

7. A personal cleansing implement comprising a substantially rectangular hydrophobic batt, said batt being a piece of knitted tubing made from extruded plastic monofilaments, said monofilaments having circular cross-sections in the range of 0.003 inches to 0.015 inches diameter, said piece of knitted tubing having a longitudinal axis, said piece of knitted tubing being inverted upon itself along said longitudinal axis to form a plurality of concentric layers of tubing, each of said layers having a similar length and substantially overlapping all other layers, said batt having a top surface, a bottom surface and two ends perpendicular to said longitudinal axis, said batt being substantially flattened perpendicular to said longitudinal axis, and said top surface and said bottom surface being bonded together at said two ends by a bonding means to maintain said batt substantially flattened, said batt comprising 8 layers of knitted tubing when substantially flattened.

8. The personal cleansing implement of claim 7 wherein said piece of knitted tubing has 6 to 9 stitches per inch as measured along said longitudinal axis.

9. The personal cleansing implement of claim 7 wherein said extruded plastic monofilament comprises linear low density polyethylene.

* * * * *